US009449573B2

(12) United States Patent
Kang et al.

(10) Patent No.: US 9,449,573 B2
(45) Date of Patent: Sep. 20, 2016

(54) LIQUID CRYSTAL DISPLAY

(71) Applicant: LG DISPLAY CO., LTD, Seoul (KR)

(72) Inventors: Jungyoul Kang, Gyeongsangbuk-do (KR); Sanggyu Kim, Gyeongsangbuk-do (KR); Yongbeom Park, Chungcheongbuk-do (KR); Sungmin Je, Daegu (KR); Kyoungkoo Lee, Gyeongsangbuk-do (KR); Hansu Kim, Daegu (KR); Yongkeun Park, Gyeongsangbuk-do (KR); Jinhee Lee, Ulsan (KR)

(73) Assignee: LG Display Co., Ltd., Seoul (KR)

( * ) Notice: Subject to any disclaimer, the term of this patent is extended or adjusted under 35 U.S.C. 154(b) by 36 days.

(21) Appl. No.: 14/069,578

(22) Filed: Nov. 1, 2013

(65) Prior Publication Data

US 2014/0184659 A1 Jul. 3, 2014

(30) Foreign Application Priority Data

Dec. 28, 2012 (KR) ..... 10-2012-0157527

(51) Int. Cl.
*G09G 3/36* (2006.01)
*G09G 5/10* (2006.01)

(52) U.S. Cl.
CPC ..... *G09G 3/3648* (2013.01); *G09G 2330/12* (2013.01); *G09G 2370/22* (2013.01)

(58) Field of Classification Search
CPC combination set(s) only.
See application file for complete search history.

(56) References Cited

U.S. PATENT DOCUMENTS

2006/0221031 A1* 10/2006 Chang et al. ..... 345/89
2007/0229434 A1* 10/2007 Liao ..... 345/98
2009/0273555 A1* 11/2009 Song ..... G09G 3/3666 345/96
2011/0032231 A1* 2/2011 Maruyama et al. ..... 345/208
2012/0092320 A1* 4/2012 Li et al. ..... 345/211
2012/0147195 A1 6/2012 Jang et al.

FOREIGN PATENT DOCUMENTS

CN 102044223 A 5/2011
CN 102543015 A 7/2012

OTHER PUBLICATIONS

Office Action dated Feb. 1, 2016, issued by the State Intellectual Property Office of the People's Republic of China in corresponding Chinese Patent Application No. 201310294314.2.

* cited by examiner

*Primary Examiner* — Srilakshmi K Kumar
*Assistant Examiner* — Stephen T Reed
(74) *Attorney, Agent, or Firm* — Morgan, Lewis & Bockius LLP

(57) ABSTRACT

A liquid crystal display includes a system and a liquid crystal module. The system detects an input frame frequency, generates a DISP signal indicating the input of an abnormal signal at a high logic level when the detected frame frequency is within a previously determined range, and generates the DISP signal at a low logic level when the detected frame frequency is beyond the previously determined range. The liquid crystal module includes a signal processing unit which selectively outputs digital video data for implementing a normal screen and digital black data for implementing a black screen in response to the DISP signal.

10 Claims, 7 Drawing Sheets

LIQUID CRYSTAL DISPLAY

This application claims the benefit of Korean Patent Application No. 10-2012-0157527 filed on Dec. 28, 2012, which is incorporated herein by reference for all purposes as if fully set forth herein.

BACKGROUND OF THE INVENTION

1. Field of the Invention

Embodiments of the invention relate to a liquid crystal display and more particularly to a liquid crystal display displaying a black image on a display panel when an abnormal signal is input.

2. Discussion of the Related Art

Liquid crystal displays display an image by adjusting a light transmittance of liquid crystal cells in response to a video signal. An active matrix liquid crystal display switches on or off a data voltage supplied to liquid crystal cells using a thin film transistor (TFT) formed in each of the liquid crystal cells, thereby actively controlling data. Therefore, the active matrix liquid crystal display may increase the display quality of a motion picture.

In some cases, an unwanted abnormal signal may be input to the liquid crystal display. A related art liquid crystal display counts a vertical sync signal using dot clocks through a timing controller and inputs a count output to a state decision unit shown in FIG. 1, thereby detecting whether or not an abnormal signal is input. The count output corresponding to a frame frequency is previously determined as a predetermined range (for example, A to B in FIG. 2) based on the input of a normal signal. When the frame frequency (i.e., the count output) is within the previously determined normal range A to B illustrated in FIG. 2 for a predetermined period of time, the related art liquid crystal display operates in a normal state. On the other hand, when the frame frequency is beyond the normal range, the related art liquid crystal display decides that there is no normal signal. Hence, the related art liquid crystal display converts all of input video data into black data and displays a black image on a display panel.

The liquid crystal display includes a liquid crystal module including the timing controller and a system supplying various signals to the liquid crystal module. In the related art liquid crystal display, because only the timing controller has a function detecting whether or not the abnormal signal is input, a design freedom of the related art liquid crystal display is reduced. Furthermore, because the normal range has to be widely set so as to increase compatibility of the timing controller, it is impossible for a user to precisely control the related art liquid crystal display. When the user wants to use a range C to D instead of the range A to B as the normal range, an internal logic of the timing controller has to be entirely changed.

When the abnormal signal is input, the related art liquid crystal display produces the black data in the system and outputs the black data to the liquid crystal module, so as to display the black image on the display panel. In this instance, the system requires a wake-up time in conformity with a series of sequence, so as to again convert the black screen into a normal screen.

SUMMARY OF THE INVENTION

Embodiments of the invention provide a liquid crystal display capable of increasing a design freedom, easily setting a desired normal range of a frame frequency, and reducing a wake-up time when an abnormal state is converted into a normal state.

In one aspect, there is a liquid crystal display including a system configured to detect an input frame frequency, generate a DISP signal indicating the input of an abnormal signal at a high logic level when the detected frame frequency is within a previously determined range, and generate the DISP signal at a low logic level when the detected frame frequency is beyond the previously determined range, and a liquid crystal module including a signal processing unit configured to selectively output digital video data for implementing a normal screen and digital black data for implementing a black screen in response to the DISP signal.

The liquid crystal module includes a liquid crystal display panel, on which the normal screen or the black screen is displayed, a data driving circuit configured to drive data lines of the liquid crystal display panel, a gate driving circuit configured to drive gate lines of the liquid crystal display panel, and a timing controller configured to control operations of the data driving circuit and the gate driving circuit. The signal processing unit is embedded in the timing controller.

The signal processing unit is implemented as a plurality of multiplexers respectively connected to output channels of the timing controller. Each of the multiplexers outputs the digital video data in response to the DISP signal of the high logic level and outputs the digital black data in response to the DISP signal of the low logic level.

The signal processing unit is implemented as a plurality of AND gates which are respectively connected to output channels of the timing controller, perform AND operation on a first input signal and a second input signal, and output a result of the AND operation. The first input signal input to each of the AND gates is selected as the digital video data, and the second input signal input to each of the AND gates is selected as the DISP signal.

The liquid crystal module includes a liquid crystal display panel, on which the normal screen or the black screen is displayed, a data driving circuit configured to drive data lines of the liquid crystal display panel, a gate driving circuit configured to drive gate lines of the liquid crystal display panel, and a timing controller configured to control operations of the data driving circuit and the gate driving circuit. The signal processing unit is embedded in the data driving circuit.

The data driving circuit includes a latch unit configured to sample and latch the digital video data received from the timing controller and output the latched digital video data to the signal processing unit, and a digital-to-analog converter configured to convert the digital video data or the digital black data received from the signal processing unit into an analog data voltage. The signal processing unit is implemented as a plurality of multiplexers connected between an output terminal of the latch unit and an input terminal of the digital-to-analog converter. Each of the multiplexers outputs the latched digital video data in response to the DISP signal of the high logic level and outputs the digital black data in response to the DISP signal of the low logic level.

The data driving circuit includes a latch unit configured to sample and latch the digital video data received from the timing controller and output the latched digital video data to the signal processing unit, and a digital-to-analog converter configured to convert the digital video data or the digital black data received from the signal processing unit into an analog data voltage. The signal processing unit is implemented as a plurality of AND gates which are connected between an output terminal of the latch unit and an input terminal of the digital-to-analog converter, perform AND operation on a first input signal and a second input signal, and output a result of the AND operation. The first input signal input to each of the AND gates is selected as the latched digital video data, and the second input signal input to each of the AND gates is selected as the DISP signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention are described below with reference to FIGS. 3 to 8.

A liquid crystal display according to the embodiments of the invention includes a liquid crystal module displaying an image and a system supplying various signals to the liquid crystal module.

In the embodiments of the invention, the system is provided with a function detecting whether or not an abnormal signal is input, and thus a design freedom of the liquid crystal display increases. A user may precisely control a desired normal range of a frame frequency without changing an internal logic of a timing controller. The system according to the embodiments of the invention detects an input frame frequency and generates a DISP signal indicating the input of an abnormal signal at a high logic level when the detected frame frequency is within a previously determined range. On the contrary, when the detected frame frequency is beyond the previously determined range, the system generates the DISP signal at a low logic level.

Figure 1:
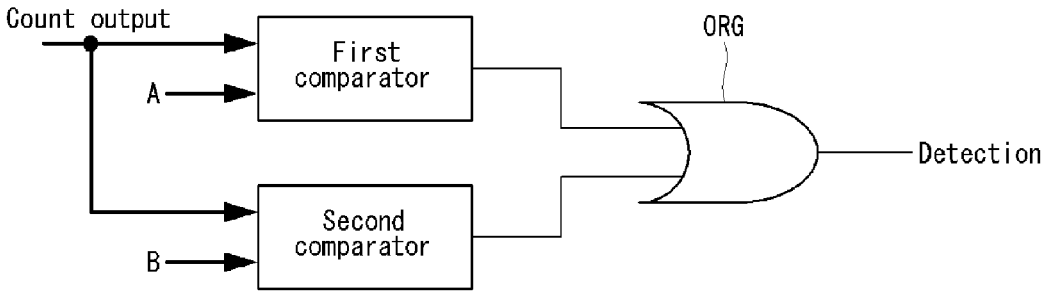
FIG. 1 (RELATED ART)
FIG. 1 shows a state decision unit which is embedded in a timing controller and decides whether a liquid crystal display is an abnormal state or a normal state.
Figure 2:
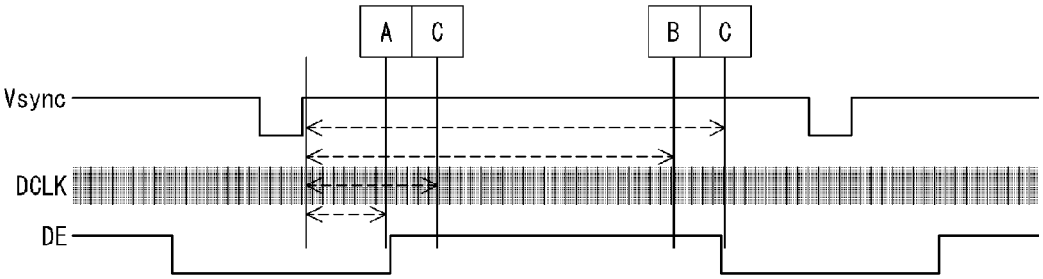
FIG. 2 (RELATED ART)
FIG. 2 illustrates a setting range of a count output corresponding to a frame frequency.
Figure 3:
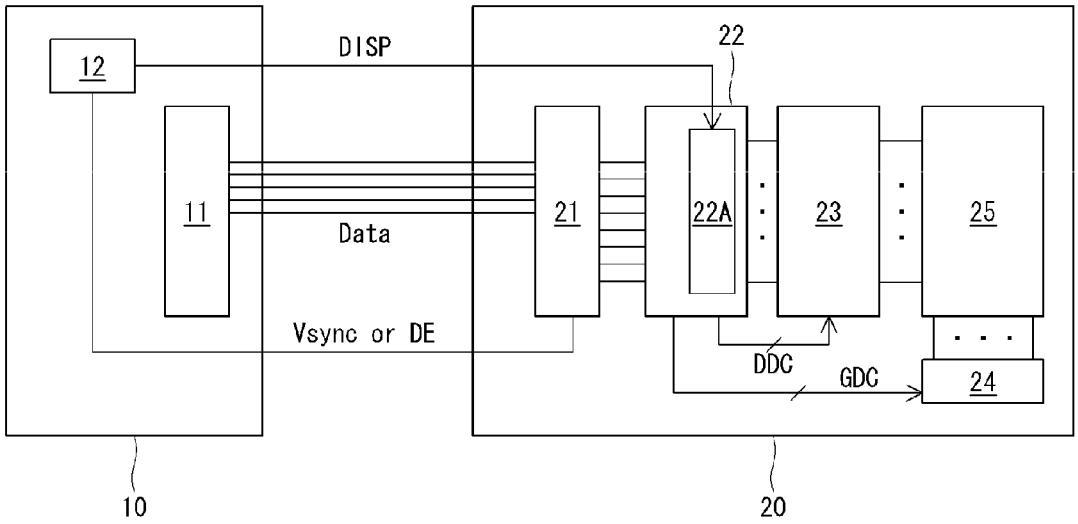
FIG. 3 illustrates a liquid crystal display according to a first embodiment of the invention.
Figure 6:
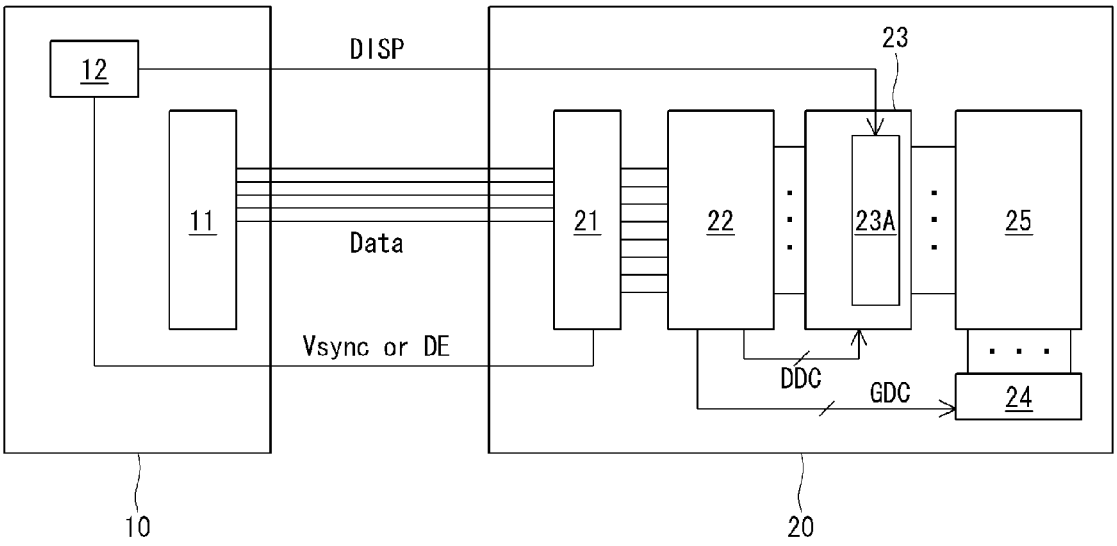
FIG. 6 illustrates a liquid crystal display according to a second embodiment of the invention.

In the embodiments of the invention, a signal processing unit implementing a black screen in an abnormal state is embedded in the liquid crystal module as shown in FIGS. 3 and 6. The signal processing unit selectively outputs digital video data for implementing a normal screen and digital black data for implementing the black screen in response to the DISP signal, thereby autonomously implementing the black screen through the simple signal processing in the liquid crystal module. Because the system according to the embodiments of the invention does not produce the digital black data and always inputs the digital video data to the liquid crystal module irrespective of the normal state and the abnormal state, the system does not require a wake-up time required in the related art when the abnormal state is converted into the normal state.

Figure 4:
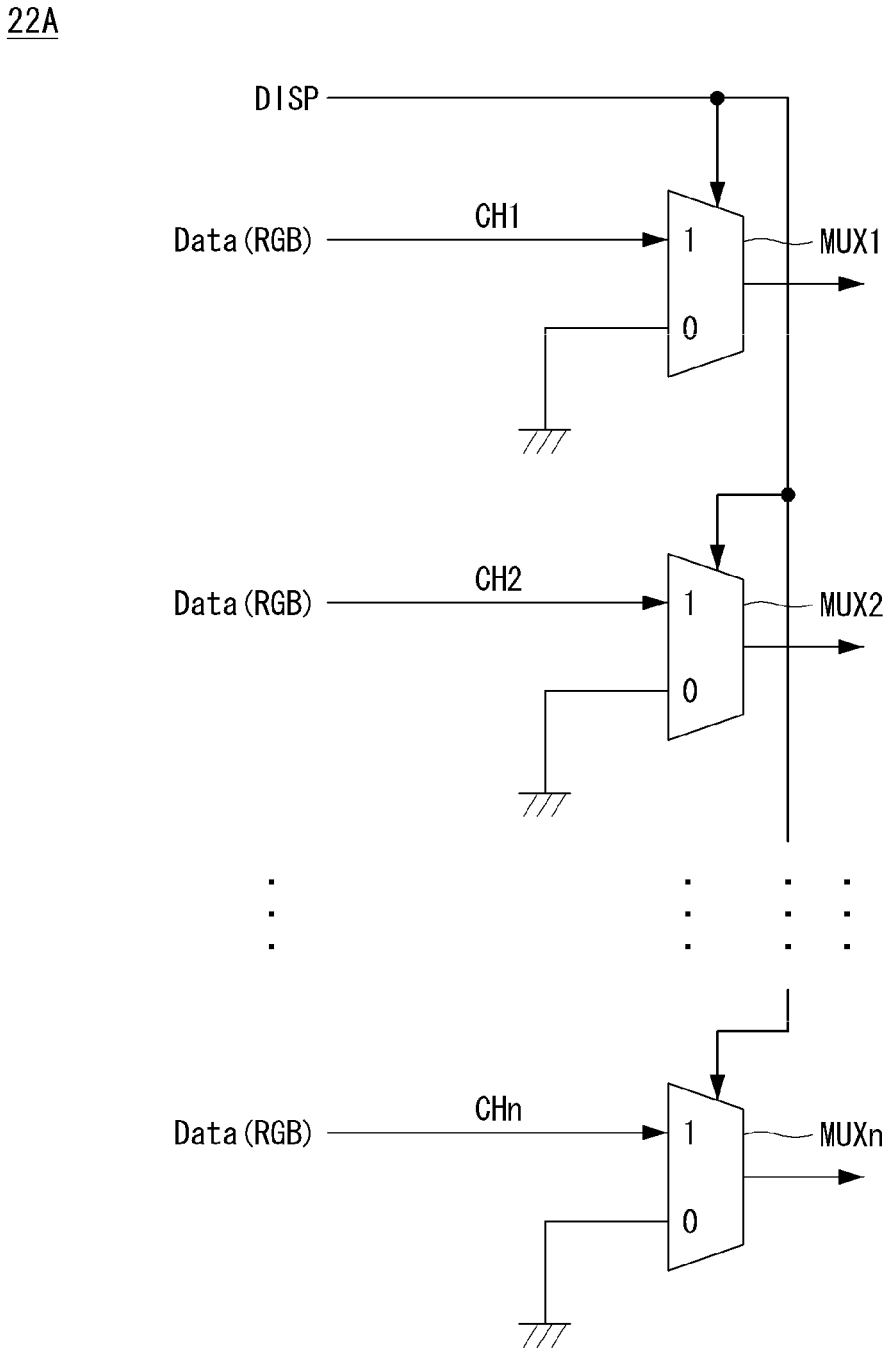
FIGS. 4 and 5 illustrate implementation examples of a signal processing unit embedded in a timing controller.
Figure 5:
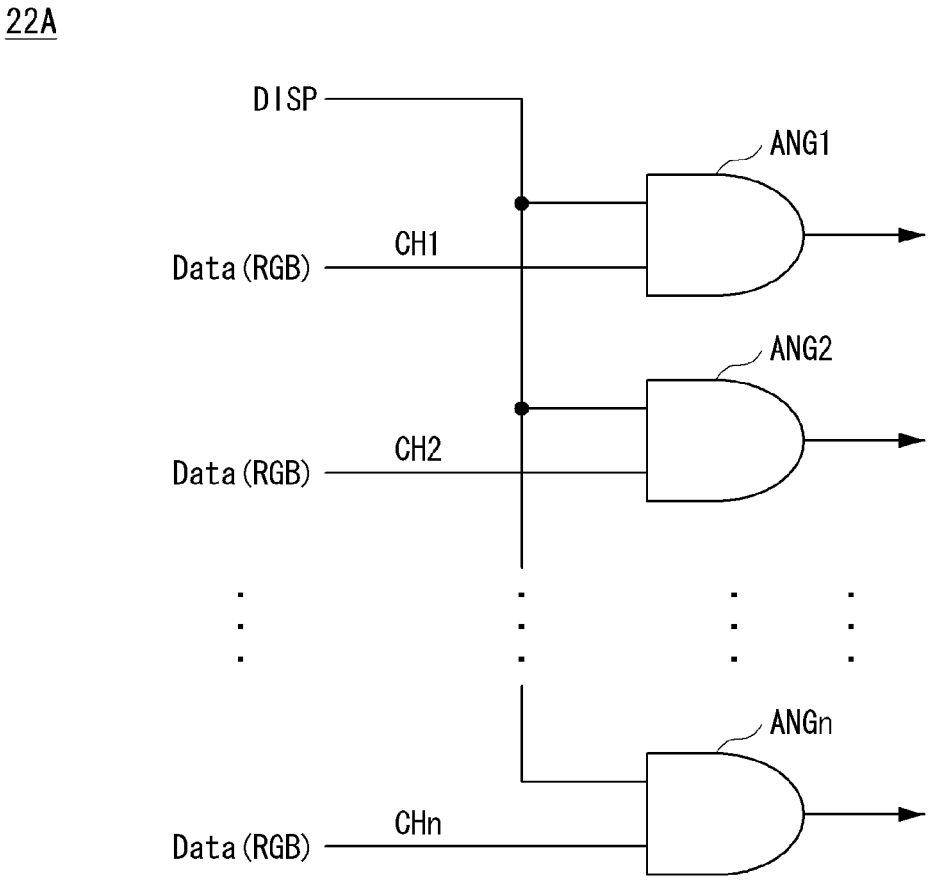
Figure 7:
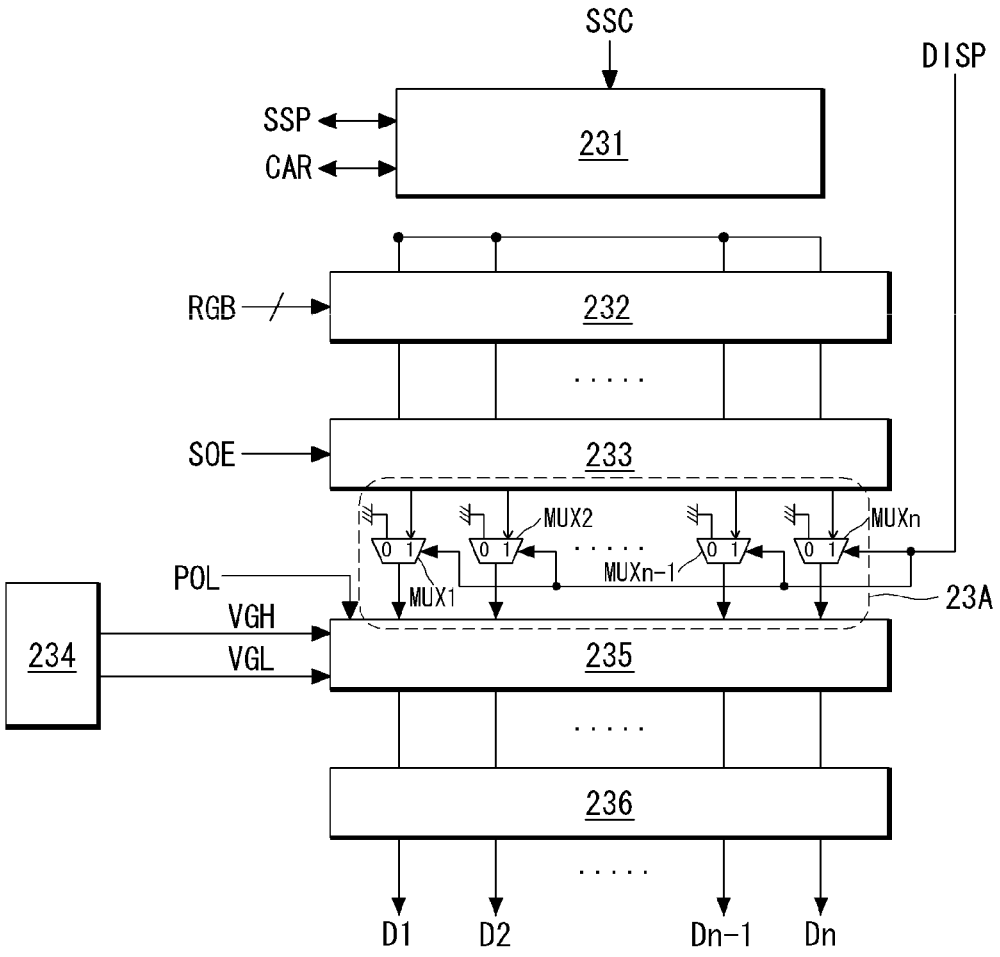
FIGS. 7 and 8 illustrate implementation examples of a signal processing unit embedded in a data driving circuit.
Figure 8:
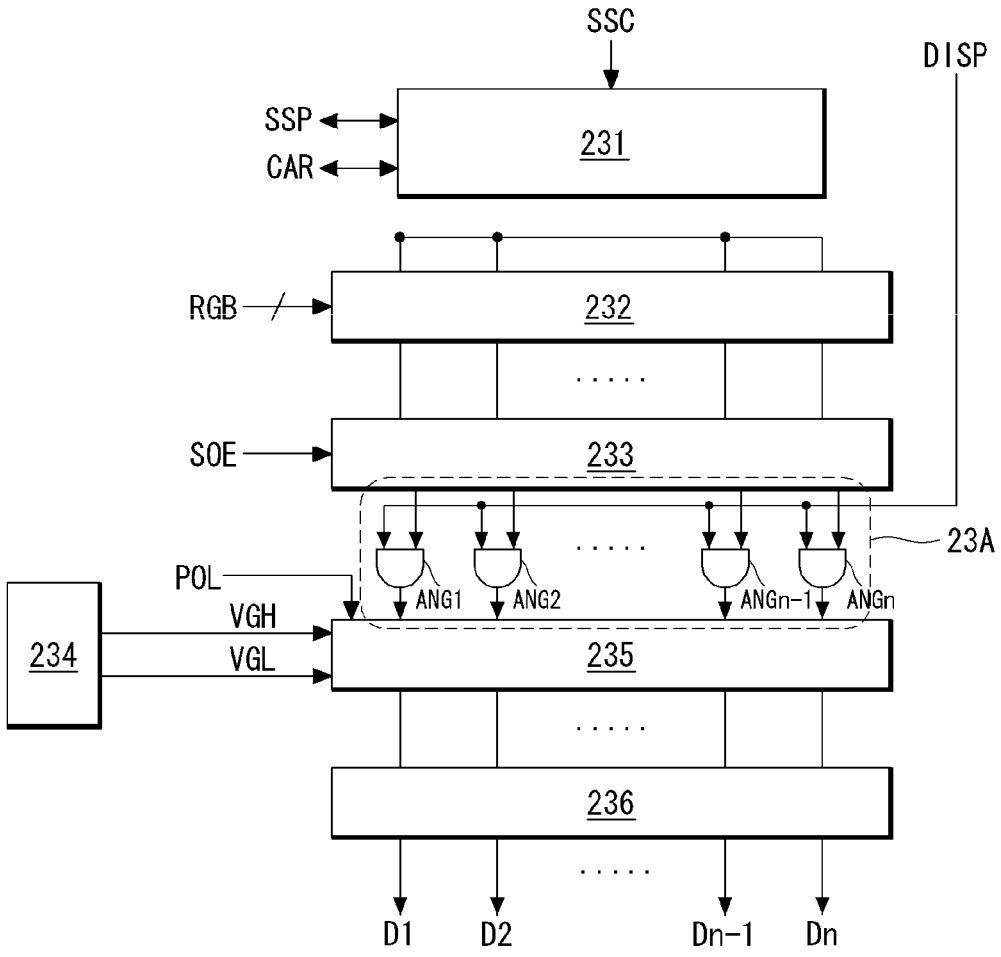

The embodiments of the invention may implement a first embodiment of the invention illustrated in FIGS. 3 to 5 and a second embodiment of the invention illustrated in FIGS. 6 to 8 based on a design position of the signal processing unit in the liquid crystal module and a means for implementing the signal processing unit.

FIG. 3 illustrates a liquid crystal display according to a first embodiment of the invention.

As shown in FIG. 3, the liquid crystal display according to the first embodiment of the invention includes a system 10 and a liquid crystal module 20.

The system 10 includes a signal transmitter 11 and a DISP signal generator 12.

The signal transmitter 11 supplies digital video data and timing signals to the liquid crystal module 20 in conformity with a regular interface standard. The timing signals include a vertical sync signal Vsync, a horizontal sync signal Hsync, a data enable signal DE, a dot clock DCLK, etc.

The DISP signal generator 12 counts the vertical sync signal Vsync or the data enable signal DE feedbacked from the liquid crystal module 20 using the dot clock DCLK and detects an input frame frequency. When the detected frame frequency is within a previously determined range, the DISP signal generator 12 generates a DISP signal indicating the input of an abnormal signal at a high logic level. On the contrary, when the detected frame frequency is beyond the previously determined range, the DISP signal generator 12 generates the DISP signal at a low logic level. The DISP signal generator 12 then outputs the DISP signal to the liquid crystal module 20.

The liquid crystal module 20 includes a signal receiver 21, a timing controller 22, a data driving circuit 23, a gate driving circuit 24, and a liquid crystal display panel 25.

The liquid crystal display panel 25 includes liquid crystal molecules positioned between an upper glass substrate and a lower glass substrate. The liquid crystal display panel 25 includes a plurality of liquid crystal cells arranged in a matrix form based on a crossing structure of data lines and gate lines. The data plurality of lines, the plurality of gate lines, a plurality of thin film transistors (TFTs), a plurality of pixel electrodes of the liquid crystal cells respectively connected to the TFTs, common electrodes positioned opposite the pixel electrodes, storage capacitors, etc. are formed on the lower glass substrate of the liquid crystal display panel 25. Black matrixes, color filters, and common electrodes are formed on the upper glass substrate of the liquid crystal display panel 25. The common electrodes are formed on the upper glass substrate in a vertical electric field driving manner such as a twisted nematic (TN) mode and a vertical alignment (VA) mode. The common electrodes are formed on the lower glass substrate along with the pixel electrodes in a horizontal electric field driving manner such as an in-plane switching (IPS) mode and a fringe field switching (FFS) mode. Polarizing plates, of which optical axes are perpendicular to each other, are respectively attached to the upper and lower glass substrates of the liquid crystal display panel 25. Alignment layers for setting a pre-tilt angle of liquid crystals are respectively formed on the inner surfaces contacting the liquid crystals in the upper and lower glass substrates of the display panel 25.

The signal receiver 21 supplies the digital video data and the timing signals, which are received from the signal transmitter 11 in conformity with the regular interface standard, to the timing controller 22.

The timing controller 22 receives the timing signals including the vertical sync signal Vsync, the horizontal sync signal Hsync, the data enable signal DE, the dot clock DCLK, etc. and generates a data control signal DDC for controlling operation timing of the data driving circuit 23 and a gate control signal GDC for controlling operation timing of the gate driving circuit 24 using the timing signals. The gate control signal GDC includes a gate start pulse GSP, a gate shift clock GSC, a gate output enable signal GOE, etc. The data control signal DDC includes a source start pulse SSP, a source sampling clock SSC, a polarity control signal POL, a source output enable signal SOE, etc.

The timing controller 22 includes a signal processing unit 22A which differently operates in response to the DISP signal received from the DISP signal generator 12. The timing controller 22 arranges the digital video data suitably for the liquid crystal display panel 25 and outputs the arranged digital video data. In this instance, the timing controller 22 selectively outputs the digital video data for implementing a normal screen and digital black data for implementing a black screen to the data driving circuit 23 in response to the DISP signal using the signal processing unit 22A. The signal processing unit 22A may be implemented as multiplexers shown in FIG. 4 or may be implemented as AND gates shown in FIG. 5.

The data driving circuit 23 latches the digital video data and the digital black data under the control of the timing controller 22 and converts the latched digital video data and the latched digital black data into positive and negative analog data voltages. The data driving circuit 23 then supplies the data voltages to the data lines of the liquid crystal display panel 25.

The gate driving circuit 24 sequentially outputs scan pulses each having a pulse width of about one horizontal period. The scan pulses are supplied to the gate lines of the liquid crystal display panel 25 and select pixel horizontal lines, to which the data voltages are applied.

FIGS. 4 and 5 illustrate implementation examples of the signal processing unit 22A embedded in the timing controller 22.

As shown in FIG. 4, the signal processing unit 22A according to the embodiment of the invention may be implemented as a plurality of multiplexers MUX1 to MUXn respectively connected to output channels CH1 to CHn of the timing controller 22.

Each of the multiplexers MUX1 to MUXn outputs digital video data RGB for implementing the normal screen in response to the DISP signal of the high logic level and outputs the digital black data for implementing the black screen in response to the DISP signal of the low logic level. Each of the multiplexers MUX1 to MUXn includes a first input terminal connected to an output channel, a second input terminal connected to a ground, and an output terminal selectively connected to the first and second input terminals in response to the DISP signal. Each of the multiplexers MUX1 to MUXn connects the first input terminal to the output terminal in response to the DISP signal of the high logic level and connects the second input terminal to the output terminal in response to the DISP signal of the low logic level. If data output from the signal processing unit 22A is 8 bits, the digital black data output from each of the multiplexers MUX1 to MUXn may be '00000000'.

Alternatively, as shown in FIG. 5, the signal processing unit 22A according to the embodiment of the invention may be implemented as a plurality of AND gates ANG1 to ANGn which are respectively connected to output channels CH1 to CHn of the timing controller 22, perform AND operation on a first input signal and a second input signal, and output a result of the AND operation.

The first input signal input to each of the AND gates ANG1 to ANGn is selected as the digital video data RGB, and the second input signal input to each of the AND gates ANG1 to ANGn is selected as the DISP signal. If data output from the signal processing unit 22A is 8 bits, the digital black data output from each of the AND gates ANG1 to ANGn may be '00000000' when the DISP signal of the low logic level is input.

FIG. 6 illustrates a liquid crystal display according to a second embodiment of the invention.

Configuration of the liquid crystal display according to the second embodiment of the invention is substantially the same as configuration of the liquid crystal display according to the first embodiment of the invention, except that a signal processing unit is not embedded in a timing controller and is embedded in a data driving circuit. Therefore, a further description thereof may be briefly made or may be entirely omitted.

A data driving circuit 23 latches digital video data and digital black data under the control of a timing controller 22 and converts the latched digital video data and the latched digital black data into positive and negative analog data voltages. The data driving circuit 23 then supplies the data voltages to data lines of a liquid crystal display panel 25.

The data driving circuit 23 includes a signal processing unit 23A which differently operates in response to a DISP signal received from a DISP signal generator 12. The data driving circuit 23 selectively inputs the latched digital video data for implementing a normal screen and the latched digital black data for implementing a black screen to a digital-to-analog converter (DAC) in response to the DISP signal using the signal processing unit 23A connected between a latch unit for sampling and latching the input digital video data and the DAC for converting the latched data into the analog data voltages. The signal processing unit 23A may be implemented as multiplexers shown in FIG. 7 or may be implemented as AND gates shown in FIG. 8.

FIGS. 7 and 8 illustrate implementation examples of the signal processing unit 23A embedded in the data driving circuit 23.

As shown in FIGS. 7 and 8, the data driving circuit 23 includes a shift register 231, a first latch array 232, a second latch array 233, a gamma compensation voltage generator 234, a digital-to-analog converter (DAC) 235, and an output unit 236. The first latch array 232 and the second latch array 233 configure a latch unit.

The shift register 231 shifts a sampling signal in response to a source sampling clock SSC. When data exceeding the number of latch operations of the first latch array 232 is supplied to the shift register 231, the shift register 231 generates a carry signal CAR.

The first latch array 232 samples the digital video data RGB received from the timing controller 22 in response to the sampling signal sequentially received from the shift register 231. The first latch array 232 latches the sampled digital video data RGB on a per horizontal line basis and simultaneously outputs the latched digital video data RGB corresponding to one horizontal line.

The second latch array 233 latches the digital video data RGB corresponding to the one horizontal line received from the first latch array 232. Then, the second latch array 233 and the second latch arrays 233 of other data driver integrated circuits (not shown) simultaneously output the latched digital video data RGB to the signal processing unit 23A during a low logic level period of a source output enable signal SOE.

The gamma compensation voltage generator 234 segments a plurality of gamma reference voltages into voltages as many as gray levels, which can be represented by the number of bits of the digital video data RGB. The gamma compensation voltage generator 234 generates positive gamma compensation voltages VGH and negative gamma compensation voltages VGL corresponding to the respective gray levels.

The DAC 235 includes a P-decoder to which the positive gamma compensation voltages VGH are supplied, an N-decoder to which the negative gamma compensation voltages VGL are supplied, and a selector for selecting an output of the P-decoder and an output of the N-decoder in response to a polarity control signal POL. The P-decoder decodes the digital video data RGB or the digital black data received from the signal processing unit 23A and outputs the positive gamma compensation voltage VGH corresponding to a gray level of the data. The N-decoder decodes the digital video data RGB or the digital black data received from the signal processing unit 23A and outputs the negative gamma compensation voltage VGL corresponding to a gray level of the data. The selector selects the positive gamma compensation voltage VGH and the negative gamma compensation voltage VGL in response to the polarity control signal POL and outputs the selected voltage as the data voltage.

The output unit 236 includes a plurality of buffers, which are respectively connected to output channels. The output unit 236 minimizes signal attenuation of the analog data voltage supplied from the DAC 235.

As shown in FIG. 7, the signal processing unit 23A according to the embodiment of the invention may be implemented as a plurality of multiplexers MUX1 to MUXn connected between an output terminal of the second latch array 233 of the latch unit and an input terminal of the DAC 235.

Each of the multiplexers MUX1 to MUXn outputs the digital video data RGB for implementing the normal screen in response to the DISP signal of a high logic level and outputs the digital black data for implementing the black screen in response to the DISP signal of a low logic level. Each of the multiplexers MUX1 to MUXn includes a first input terminal connected to an output terminal of the latch unit, a second input terminal connected to a ground, and an output terminal selectively connected to the first and second input terminals in response to the DISP signal. Each of the multiplexers MUX1 to MUXn connects the first input terminal to the output terminal in response to the DISP signal of the high logic level and connects the second input terminal to the output terminal in response to the DISP signal of the low logic level. If data output from the signal processing unit 23A is 8 bits, the digital black data output from each of the multiplexers MUX1 to MUXn may be '00000000'.

Alternatively, as shown in FIG. 8, the signal processing unit 23A according to the embodiment of the invention may be implemented as a plurality of AND gates ANG1 to ANGn which are connected between the output terminal of the second latch array 233 of the latch unit and the input terminal of the DAC 235, perform AND operation on a first input signal and a second input signal, and output a result of the AND operation.

The first input signal input to each of the AND gates ANG1 to ANGn is selected as the digital video data RGB, and the second input signal input to each of the AND gates ANG1 to ANGn is selected as the DISP signal. If data output from the signal processing unit 23A is 8 bits, the digital black data output from each of the AND gates ANG1 to ANGn may be '00000000' when the DISP signal of the low logic level is input.

As described above, the embodiment of the invention provides the system with the function detecting whether or not the abnormal signal is input, thereby increasing the design freedom of the liquid crystal display. The embodiment of the invention may precisely control the desired normal range of the frame frequency without changing the internal logic of the timing controller. The embodiment of the invention embeds the signal processing unit implementing the black screen in the abnormal state in the liquid crystal module and selectively outputs the digital video data for implementing the normal screen and the digital black data for implementing the black screen depending on whether or not the abnormal signal is input. Because the system according to the embodiment of the invention does not produce the digital black data and always inputs the digital video data to the liquid crystal module irrespective of the normal state and the abnormal state, the system does not require the wake-up time required in the related art when the abnormal state is converted into the normal state.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display, comprising:

a system configured to:

detect an input frame frequency;

generate a signal indicating the input of an abnormal signal at a high logic level when the detected frame frequency is within a previously determined range; and generate the signal at a low logic level when the detected frame frequency is beyond the previously determined range; and a liquid crystal module including a signal processing unit configured to selectively output:

digital video data for implementing a normal screen; and digital black data for implementing a black screen in response to the signal, wherein the system is separated from the liquid crystal module, and wherein the system is further configured to detect the input frame frequency using a feedback signal from the liquid crystal module.

2. The liquid crystal display of claim 1, wherein the liquid crystal module includes:

a liquid crystal display panel, on which the normal screen or the black screen is displayed;

a data driving circuit configured to drive data lines of the liquid crystal display panel;

a gate driving circuit configured to drive gate lines of the liquid crystal display panel; and a timing controller configured to control operations of the data driving circuit and the gate driving circuit, wherein the signal processing unit is embedded in the timing controller.

3. The liquid crystal display of claim 2, wherein:

the signal processing unit is implemented as a plurality of multiplexers respectively connected to output channels of the timing controller; and each of the multiplexers is configured to:

output the digital video data in response to the signal of the high logic level; and output the digital black data in response to the signal of the low logic level.

4. The liquid crystal display of claim 2, wherein:

the signal processing unit is implemented as a plurality of AND gates which are respectively connected to output channels of the timing controller, each of the plurality of AND gates being configured to:

perform an AND operation on a first input signal and a second input signal; and output a result of the AND operation; and the first input signal input to each of the AND gates is selected as the digital video data; and the second input signal input to each of the AND gates is selected as the signal.

5. The liquid crystal display of claim 1, wherein the liquid crystal module includes:

a liquid crystal display panel, on which the normal screen or the black screen is displayed;

a data driving circuit configured to drive data lines of the liquid crystal display panel;

a gate driving circuit configured to drive gate lines of the liquid crystal display panel; and a timing controller configured to control operations of the data driving circuit and the gate driving circuit, wherein the signal processing unit is embedded in the data driving circuit.

6. The liquid crystal display of claim 5, wherein the data driving circuit includes:

a latch unit configured to:

sample and latch the digital video data received from the timing controller; and output the latched digital video data to the signal processing unit; and a digital-to-analog converter configured to convert the digital video data or the digital black data received from the signal processing unit into an analog data voltage, wherein the signal processing unit is implemented as a plurality of multiplexers connected between an output terminal of the latch unit and an input terminal of the digital-to-analog converter, and wherein each of the plurality of multiplexers is configured to:

output the latched digital video data in response to the signal of the high logic level, and output the digital black data in response to the signal of the low logic level.

7. The liquid crystal display of claim 5, wherein the data driving circuit includes:

a latch unit configured to:

sample and latch the digital video data received from the timing controller; and output the latched digital video data to the signal processing unit; and a digital-to-analog converter configured to convert the digital video data or the digital black data received from the signal processing unit into an analog data voltage, wherein the signal processing unit is implemented as a plurality of AND gates which are connected between an output terminal of the latch unit and an input terminal of the digital-to-analog converter, each of the plurality of AND gates being configured to:

perform an AND operation on a first input signal and a second input signal, and output a result of the AND operation, wherein the first input signal input to each of the AND gates is selected as the latched digital video data, and wherein the second input signal input to each of the AND gates is selected as the signal.

8. The liquid crystal display of claim 1, wherein the feedback signal includes a vertical sync signal or a data enable signal feedbacked from the liquid crystal module.

9. The liquid crystal display of claim 1, wherein the system includes:

a signal transmitter configured to supply the digital video data and timing signals to the liquid crystal module; and a signal generator configured to:

count the feedback signal using a dot clock;

detect the input frame frequency;

generate the signal; and output the signal to the liquid crystal module.

10. The liquid crystal display of claim 9, wherein the timing signals include at least one of: a vertical sync signal, a horizontal sync signal, a data enable signal, and the dot clock.

* * * * *